US005649868A

United States Patent [19]

Gooss et al.

[11] Patent Number: 5,649,868

[45] Date of Patent: Jul. 22, 1997

[54] HORIZONTAL BALL-RETURN MECHANISM

[75] Inventors: Lawrence Gooss, Mechanicsville; William M. Riley, Richmond, both of Va.

[73] Assignee: AMF Bpwling, Inc., Mechanicsville, Va.

[21] Appl. No.: 682,291

[22] Filed: Jul. 17, 1996

[51] Int. Cl.[6] ..... A63D 5/02

[52] U.S. Cl. ..... 473/106; 473/110; 473/111

[58] Field of Search ..... 473/73, 98, 106, 473/107, 110, 111

[56] References Cited

U.S. PATENT DOCUMENTS

| | | | |
|---|---|---|---|
| 3,018,104 | 1/1962 | Gautraud et al. | 473/106 |
| 3,300,212 | 1/1967 | Cornell | 473/110 |
| 3,386,735 | 6/1968 | Rogers | 473/110 |
| 5,076,582 | 12/1991 | Edwards | 473/111 |

FOREIGN PATENT DOCUMENTS

| | | | |
|---|---|---|---|
| 2352566 | 5/1974 | Germany | 473/110 |
| 1036956 | 7/1966 | United Kingdom | 473/110 |
| 1396117 | 6/1975 | United Kingdom | 473/110 |

*Primary Examiner*—William M. Pierce
*Attorney, Agent, or Firm*—David E. Dougherty

[57] ABSTRACT

A horizontal ball return mechanism for propelling a bowling ball from one end of a bowling alley to the other includes a generally horizontal track with compression and decompression sections and a generally flat horizontal section therebetween. Two pulleys and an endless belt move a bowling ball along the track. The compression, decompression and a flat horizontal section lift a bowling ball upwardly against the belt, maintain the belt under compression as the ball moves along the generally flat section and lowers the ball before it passes under a second of the pulleys.

7 Claims, 4 Drawing Sheets

HORIZONTAL BALL-RETURN MECHANISM

FIELD OF THE INVENTION

This invention relates to an improved ball-return mechanism and, more particularly, to a horizontal ball-return mechanism for propelling a bowling ball from the pit end of the bowling alley to the approach section of the alley.

BACKGROUND OF THE INVENTION

Bowling alley return mechanisms are well known and generally fall into two categories. The first of these categories includes a bowling ball lifting apparatus such as the one disclosed in U.S. Pat. No. 5,076,582 of Edwards. In such systems, a bowling ball lifting or elevating mechanism, such as an endless belt and track combination, lifts the balls to a runway or return race. The runway is inclined so that a ball rolls down the incline toward the approach end of a lane where the ball is braked and lifted up to a level at which the bowler can conveniently reach it.

The second category of ball-returns includes a horizontal ball-return wherein a ball is fed to a conveyor which accelerates the ball and propels it down the alley, i.e., down a ball-return trough. Such systems are capable of returning a ball to a bowler in less time, but have typically been plagued by problems associated with bowling pins entering into the ball-handling apparatus and jamming the mechanism.

A recent development in the ball-handling apparatus is described in our co-pending application, Ser. No. 08/615,900, filed on Mar. 14, 1996, and entitled Ball Return Mechanism. That application is assigned to the same assignee as the present invention and is incorporated herein in its entirety by reference. The ball-handling mechanism described therein has, to a large degree, eliminated problems associated with the pins entering into the mechanism and/or reaching the horizontal ball-return.

However, the more rapid transition of the bowling ball from the pit to the horizontal ball-return has led to a problem which is attributed to variations in bowling balls, i.e., a range in weight from 6 pounds to 16 pounds. The lighter balls are accelerated more rapidly and are propelled out of the horizontal ball-return at a greater speed than the heavier balls. The problem is that when a lighter ball follows a heavy ball, it may catch up and strike the heavier ball in the return trough. As a result, the lighter ball transfers its energy to the heavier ball and stops short of the approach section. When this happens, the lighter ball does not reach the approach section and must be retrieved.

It has now been found that an improved horizontal bowling ball-return mechanism in accordance with the present invention overcomes the aforementioned problem. Accordingly, when accompanied by the ball-handling apparatus described in the aforementioned application, the mechanism returns a bowling ball from the pit in less time than the prior art mechanism. For this reason, the bowler does not have as long to wait for the return of his ball. Consequently, the game is speeded up so that more games per hour are bowled. This also reduces the waiting time for those bowlers who are waiting to bowl, and, at the same time, increases a bowling center's return on investment.

It is presently believed that there is a large commercial market for a horizontal ball-return mechanism according to the present invention. It is also believed that such mechanisms can be manufactured and sold at a competitive price. In addition, the mechanisms are durable and are relatively easy to install and service. Such mechanisms can also be used to replace prior art mechanisms.

BRIEF SUMMARY OF THE INVENTION

In essence, the present invention contemplates an improved horizontal ball-return mechanism for propelling a bowling ball from the pit end of a bowling alley to the approach section of the alley. The mechanism includes a generally horizontal track and a conveyor belt, which is disposed above the track at a distance which is slightly less than the diameter of the bowling ball. The conveyor belt includes a pair of pulleys and an endless belt passing around the pulleys in a conventional manner. The conveyor belt and track also form an entrance area where the conveyor belt first contacts a bowling ball which is on the track and an exit area where the ball leaves the mechanism and is no longer in contact with the belt. Means are also provided for driving the belt in a direction wherein the flat portions thereof are moving in a direction which is substantially parallel to the track. In this manner, the lower portion of the belt is moving toward the approach section of the alley so that the bowling ball will be propelled from the pit end of the alley toward the approach section.

A horizontal ball-return in accordance with a preferred embodiment of the invention includes a generally horizontal track with a slight rise in a first portion and a slight decline in a second portion. A conveyor belt is disposed above the track at a distance which is slightly less than the diameter of a bowling ball. In this embodiment, the slight rise in the track forms a compression section, while the decline forms a decompression section. A generally flat section of the track connects the compression and decompression sections. The compression and decompression sections are disposed inwardly of the pulleys and constructed and arranged to lift a bowling ball upwardly against the conveyor belt after it passes a first of the pulleys and thereby compress the endless belt. In this embodiment of the invention, the bowling ball is lifted to a height above the lower section of the track which is between ¼ and ½ of the diameter of the ball, and preferably about 40% of its diameter. The ball is then lowered by an equal amount in the decompression section, so that it passes freely under the second pulley.

The invention will now be described in connection with the accompanying drawings, wherein like reference numerals have been used to designate like parts.

DETAILED DESCRIPTION OF THE PREFERRED EMBODIMENT OF THE INVENTION

Figure 1:
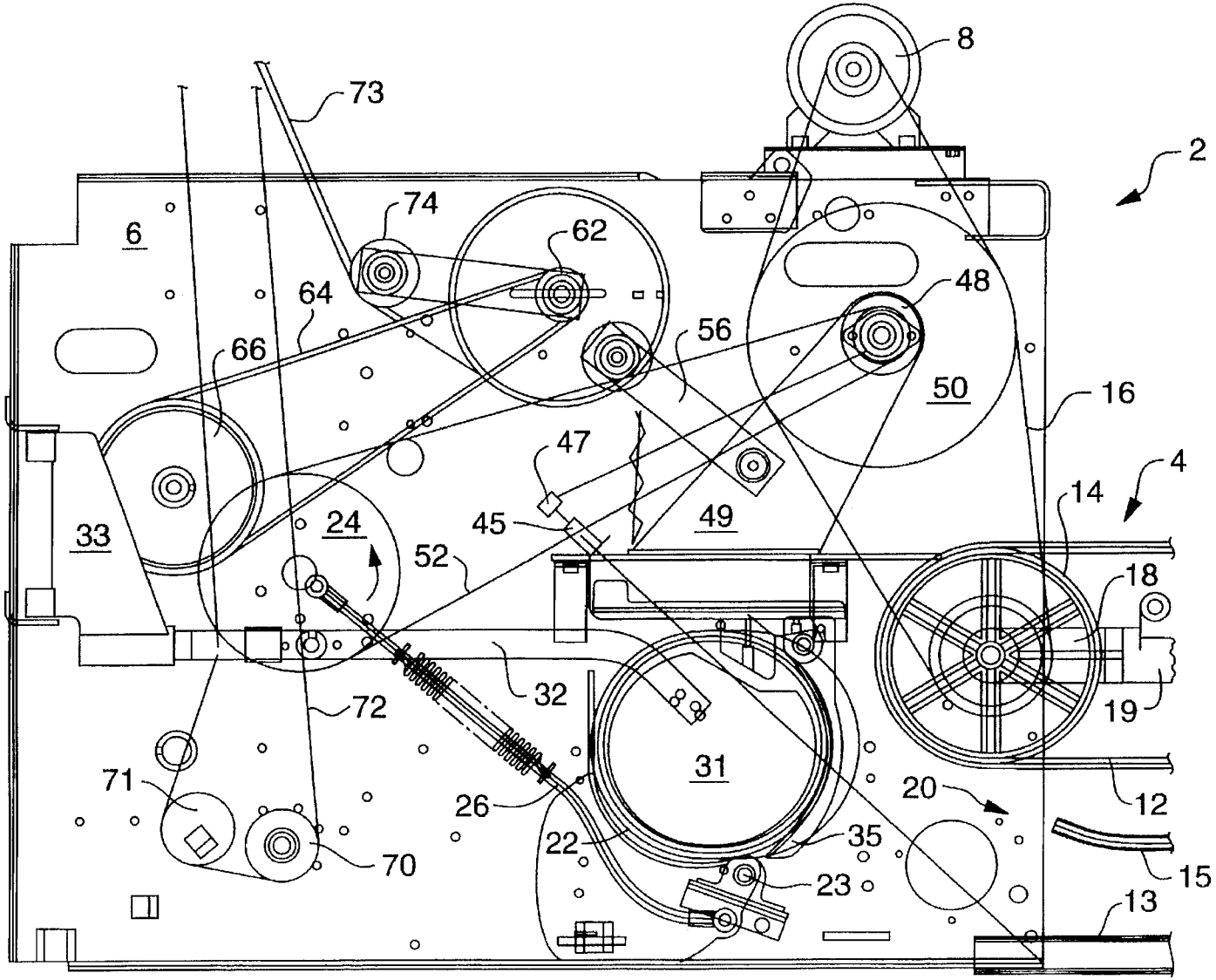
FIG. 1 is a side view with an outer cover removed to show the ball-handling mechanism and a portion of a horizontal ball-return mechanism.

FIG. 1 is a side view with an outside wall removed to illustrate the various elements of a bowling ball-handling mechanism 2. As illustrated, the various elements of a ball-handling subassembly are disposed between a pair of sidewalls 6 (only one of which is shown). The sidewalls 6 define a chamber for holding the subassembly. A horizontal ball return 4 and motor 8 may be disposed on the outside of the chamber, or extended outwardly therefrom, as in the case of the horizontal ball-return 4. For example, the horizontal ball-return 4 may extend into the chamber between the sidewalls 6 for receiving a bowling ball from the ball-handling subassembly and then propelling the ball toward the approach section of an alley. The horizontal bowling ball-return mechanism 4 includes an endless belt 12, a track 13 and a bowling ball guide 15 which maintains the bowling ball on the track 13. This horizontal ball-return is designed for receiving a bowling ball thereon and therebetween. For example, the belt 12 accelerates a bowling ball as it rolls along the track 13 by frictional engagement between the ball and the belt 12. Thus, it is important that pressure be applied by the belt-supporting mechanism to maintain a firm contact between the ball and the belt 12.

Figure 4:
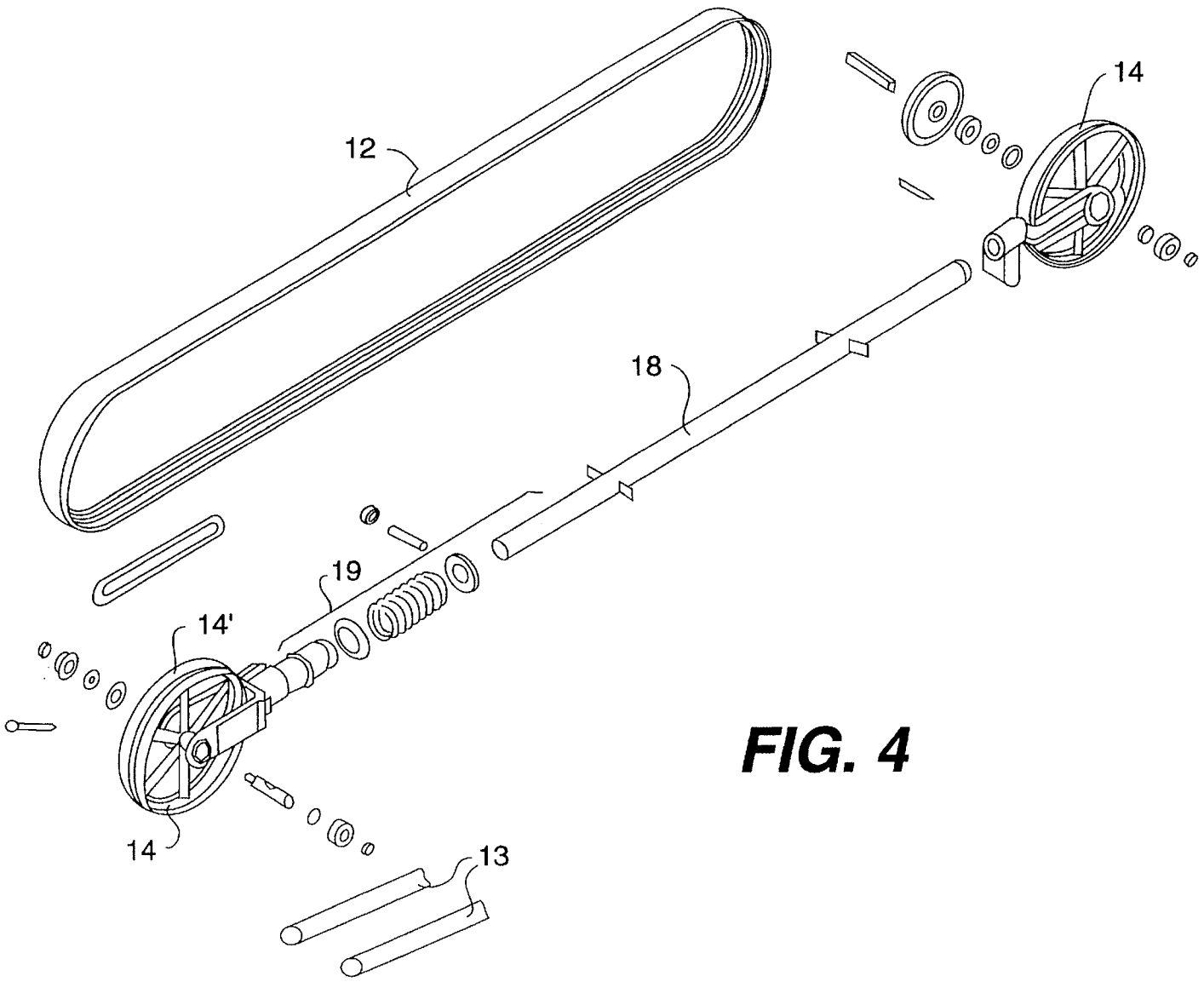
FIG. 4 is an exploded perspective view of a belt assembly for use in a horizontal ball-return mechanism according to the present invention.

The belt 12 is moved and supported by two pulleys 14 and 14' (only one of which is shown in FIG. 1) which are rotatably mounted on an elongated tubular support member 18 (see FIG. 4). The support member 18 includes a tensioning mechanism 19 for biasing the pulleys 14 and 14' away from each other to thereby provide tension on the belt 12. The tensioning mechanism 19 is of a conventional design which will be well understood by a person of ordinary skill in the art.

The ball-handling subassembly is disposed adjacent to the horizontal ball-return 4 and is constructed and arranged to deliver a bowling ball to an entrance area 20 of the ball-return 4. The entrance area 20 is defined as the area between the belt 12 and track 13 where a bowling ball enters the horizontal ball-return. The subassembly also includes a ball-contacting member such as a concave or crescent-shaped cradle 22. The cradle 22 is designed to receive a bowling ball thereon and to support the bottom and rear surface of a bowling ball. The cradle 22 is also designed to prevent pins from entering the ball-return area. While a bowling ball is spherical in shape, the bottom portion refers to that portion of a ball which is resting on the cradle 22, while the rear portion refers to the part of a ball which is away from the horizontal ball-return and which rests against an upwardly extending portion of the cradle 22.

Figure 2:
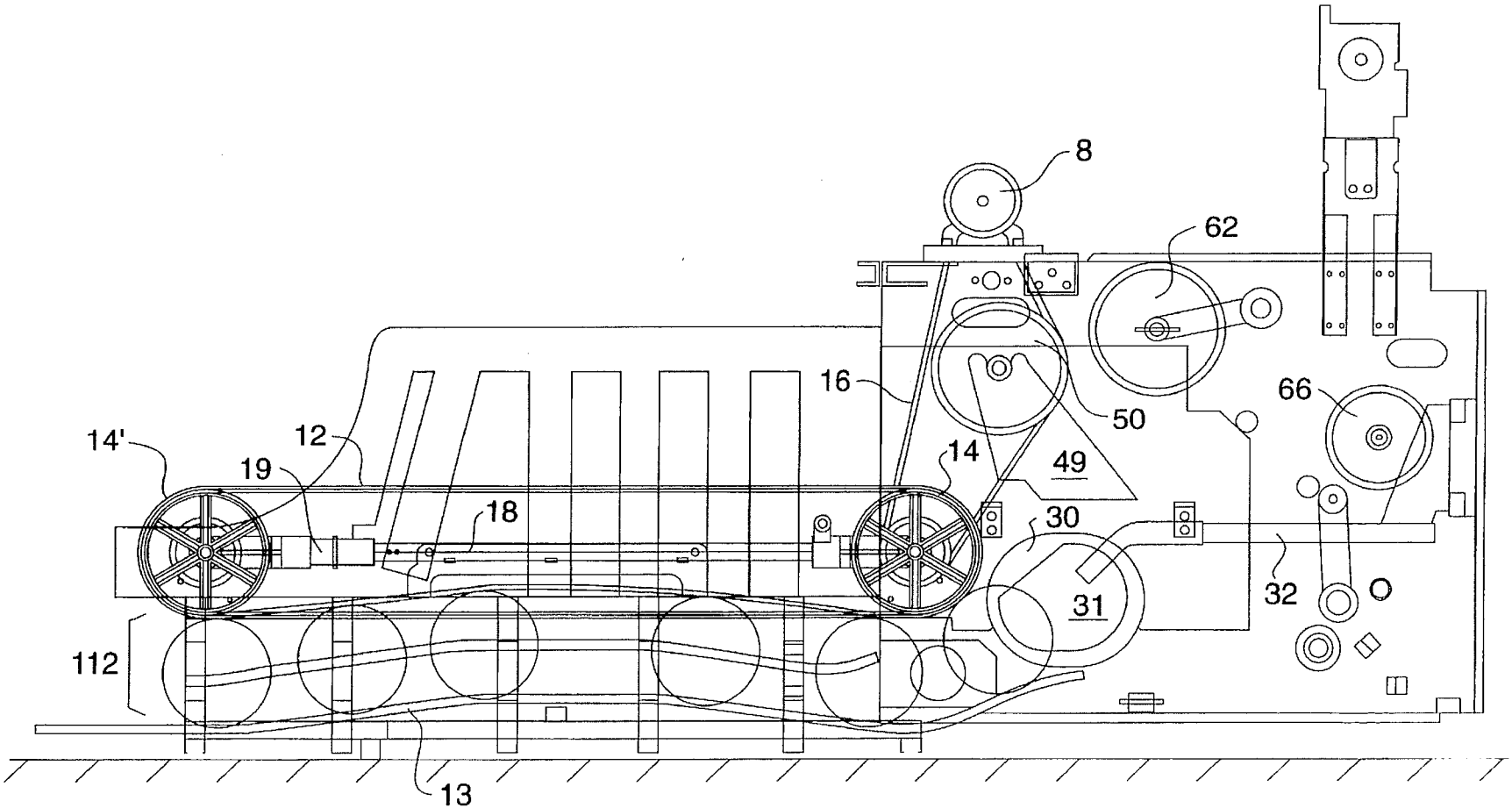
FIG. 2 is a side elevational view of the horizontal bowling ball-return mechanism according to a preferred embodiment of the invention and the ball-handling mechanism, as shown in more detail in FIG. 1.

In the ball-handling mechanism shown in FIG. 2, the cradle 22 is pivotally mounted within the sidewall 6 on a pivot 23. This pivot 23 is positioned below the bowling ball and toward a forward portion of the bowling ball. The cradle 22 and a bowling ball resting thereon are lifted upwardly and forwardly by a means of a crank pulley 24 and linkage 26, as described in more detail in our aforementioned pending application.

Each of the sidewalls 6 includes a ball opening or ball door 30 (see FIG. 2) through which bowling balls leave the pit and enter into the range of operation of the bowling ball-handling mechanism in a conventional manner. The opening 30 is adjacent to the cradle 22, so that a bowling ball which is delivered by the pit assembly (not shown) through the opening 30 rolls onto the cradle 22.

A paddle 31 that fits within the circumference of ball openings 30 oscillates back and forth between the two openings to prevent a second bowling ball from entering into the ball-return mechanism when a first bowling ball is entering the area. The paddle 31 is connected to a support rod 32 which is pivotal about a vertical axis with a ball-sensor mechanism 33. This ball-sensor mechanism is mechanical in nature and conventional and incorporated in other ball-handling systems. The paddle mechanism also includes a mechanical light-ball sensor, as will be well understood by those skilled in the art.

The ball-handling mechanism also includes a pivotally-mounted exit door 35, which is disposed adjacent to the ball opening and sidewall 6 and between the cradle 22 and the horizontal ball-return 4. As shown, the exit door 35 is pivoted from the upper portion thereof about a rod 36, so that it swings forwardly toward the horizontal ball-return 4 and upwardly as it opens in response to a bowling ball being pushed through the door 35 as the bowling ball is moved forwardly by the cradle 22 and/or downwardly, due to gravity. A locking assembly locks the door 35 in a closed position to prevent any flying pins from entering the horizontal ball-return or otherwise jamming the mechanism. The locking member and door 35 also prevent any pins which had fallen onto the cradle 22 from being delivered to the horizontal ball-return 4.

An optical sensor 45 is mounted above the locking member with a line of sight which passes through a space which is occupied by a portion of a bowling ball when the ball is on the cradle 22 or positioned for return. An alternative sensor arrangement includes a plurality of sensors which are adapted to respond to the geometric shape and size of a bowling ball in order to distinguish a bowling ball over one or more pins which might land on the cradle The optical sensor 45 is of a conventional design as, for example, a Banner Series S18 retroflector sensor which is available from Banner engineering Corp., of Minneapolis, Minn. Such sensors may incorporate a mirror 46. The sensor 45 has a line of sight which detects the presence of a bowling ball when a portion of the surface of the ball interrupts the light beam. Having the line of sight passing through an upper and forward position of a bowling ball further reduces the likelihood of the line of sight being broken by a flying pin.

The sensor 45 produces a signal when a bowling ball is within its line of sight and, by means of a suitable circuit 47, actuates a clutch 48 which is then driven by an outer drive pulley 50. This outer drive pulley 50 is continuously rotated by means of a motor 8 acting through a drive belt 16 which also powers the pulley 14 of the horizontal ball-return 4. The circuit may be of any suitable design as, for example, those used in conveyor controls. Such circuits are well within the capabilities of a personal of ordinary skill in the art. For example, a suitable circuit means 47 may be based on a time delay, so that the passing of an oscillating paddle or flying pin will not actuate the mechanism.

Upon receiving a signal from the sensor, the clutch assembly 48 is engaged and rotates the crank pulley 24, by means of a belt 52, approximately ¾ of a revolution, to thereby move the linkage 26 which causes the cradle 22 to rotate about pivot 23. As shown in FIG. 1, the pulley 50 and clutch 48 are supported by a bracket 49, which also supports a conventional belt-tension device 56 for maintaining tension on the drive belt 52.

The oscillating paddle 39 is driven by means of pulley 60 and clutch 62 which may be rotated by a separate source of power (not shown). The clutch 62 has a conventional mechanical override, as will be well understood by those skilled in the art. The clutch 62 rotates a belt 64 to thereby rotate the pulley 66 to provide oscillating movement to the paddle 31 in a conventional manner.

A separate drive means, including a pair of pulleys 70 and 71 and an endless belt 72, is also shown in FIG. 1. This drive means rotates a pit carpet (not shown) through pulley 70 and may also be connected through a belt 73 for rotating the pulley 60 for moving the paddle 31. A conventional belt-tensioner 74 maintains tension on the belt 73.

As shown in FIG. 2, the horizontal ball-return 4 includes an endless belt 12, and track 13. The horizontal ball-return also includes a pair of pulleys 14 and 14' with the endless belt 12 in engagement with and passing around the pulleys 14 and 14'. As shown in FIGS. 1 and 2, the pulley 14 is driven by motor 8 by means of belt 16. The entrance area 20 is defined as that point where the bowling ball is supported by the track 13 and is first engaged by the belt 12. The ball B is then accelerated along the track 13 by the belt 12 and leaves the horizontal ball-return at an exit area 112.

Figure 3:
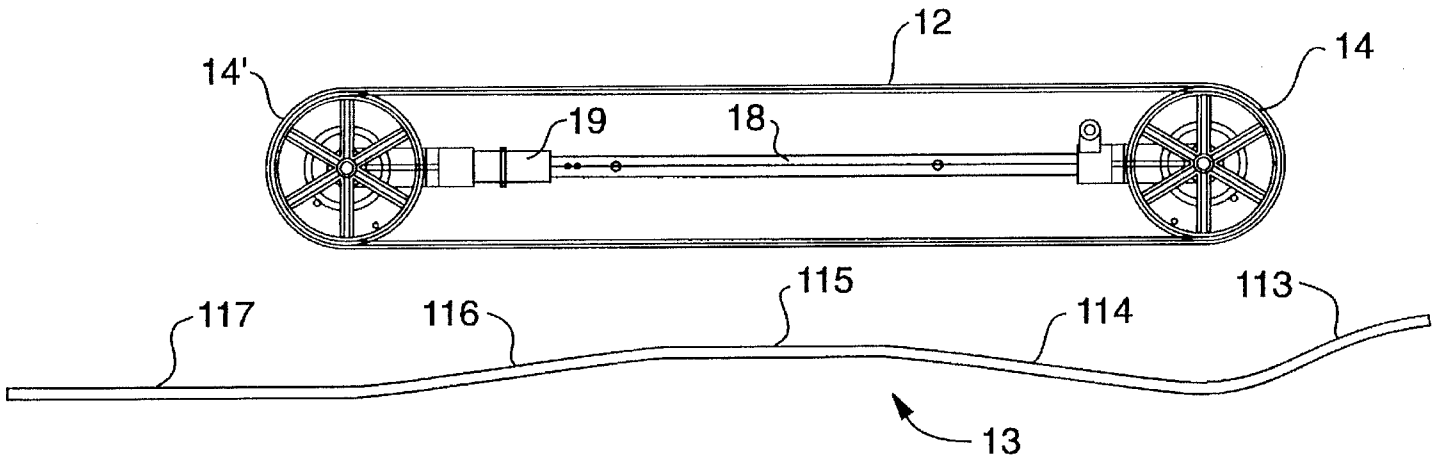
FIGS. 3A and 3B illustrate the track configuration, or pathway, of a bowling ball return mechanism according to a preferred embodiment of the invention.

As illustrated in FIG. 2–4, the track 13 includes a ball-receiving portion 113 having a downward slope for receiving a bowling ball. The bowling ball then rolls down portion 113 into the ball entrance area 20, where it is engaged by belt 12. Then, after the bowling ball passes under the pulley 14, the track 13 rises upwardly by a distance which is between one-fourth and one-half of the diameter of a bowling ball. The riser portion 114 provides a compression area where the bowling ball is forced upwardly against the belt 12 to increase the tension thereon.

Figure 3B:
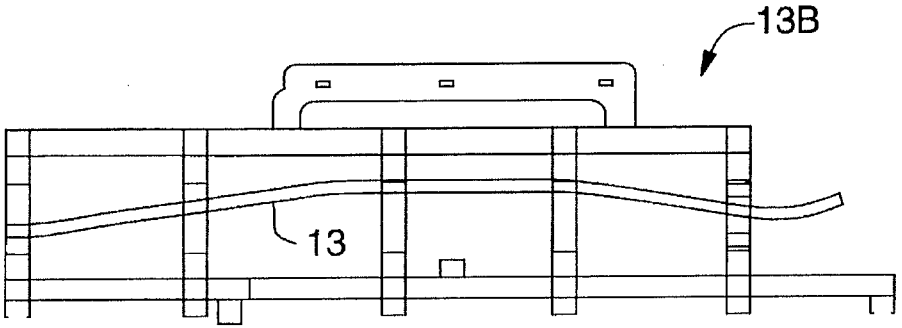

A relatively flat portion 115 on the track maintains a bowling ball tightly against the belt 12 as it is accelerated along the track 13. The bowling ball is accelerated along the pathway until it approaches a downwardly sloping portion 116 which drops the ball to a level where it will pass under the pulley 14' and onto a runway 117 for return to the approach section of the alley. As shown in FIG. 3B, a structure **13*b* supports the track 13** by any suitable means and is merely representative of a suitable structural support.

While the invention has been described in connection with its preferred embodiment, it should be recognized that changes and modifications may be made therein without departing from the scope of the appended claims.

We claim:

1. A horizontal ball-return for propelling a bowling ball along the length of a bowling alley comprising a generally horizontal track means with compression and decompression sections and a generally flat horizontal section connecting said compression and decompression sections, two pulleys and an endless belt passing around said pulleys with a portion thereof parallel to said generally flat horizontal section, and means for driving said belt in a first direction for moving a bowling ball along the track by frictional engagement between the ball and said belt, said compression, decompression and generally flat horizontal sections disposed inwardly between and below said pulleys and constructed and arranged to lift a bowling ball upwardly at a distance which is about 40% of the diameter of the bowling ball against said belt after it passes a first of said pulleys to thereby compress said belt, maintain said belt under compression as the ball moves along said generally flat horizontal section and to lower the ball to reduce the compression of said belt before the ball passes under the second of said pulleys and onto a horizontal runway.

2. A horizontal ball-return for propelling a bowling ball along the length of a bowling alley according to claim 1 which includes an elongated support member extending between said two pulleys.

3. A bowling ball-return for returning a bowling ball along the length of a bowling alley according to claim 2 in which said elongated support member includes means for maintaining tension on said belt.

4. A horizontal ball-return for propelling a bowling ball along the length of a bowling alley according to claim 3 in which said track defines an arc-shaped section for lifting the ball a distance of about one-fourth of the radius of said pulley.

5. A horizontal ball-return for propelling a bowling ball along the length of a bowling alley according to claim 4 in which said track defines a second arc for lowering the bowling ball a distance of about one-quarter of the radius of said pulley before said ball passes under a second of said pulleys.

6. A horizontal ball-return for propelling a bowling ball along the length of a bowling alley according to claim 1 in which said endless belt is disposed so that its upper and lower runs are disposed each in a horizontal plane.

7. A horizontal ball-return for propelling a bowling ball along the length of a bowling alley comprising an entrance area, an exit area and a generally horizontal track means with compression and decompression sections and a generally flat horizontal section connecting said compression and decompression sections, said track means also including a first downwardly sloping section for delivering a bowling ball to said entrance area, two pulleys and an endless belt passing around said pulleys with a portion thereof parallel to said generally flat horizontal section, and means for driving said belt in a first direction for moving a bowling ball from said entrance area along the track by frictional engagement between the ball and said belt, said compression, generally flat horizontal and decompression sections disposed inwardly between and below said pulleys and constructed and arranged to lift a bowling ball upwardly by a distance which is about 40% of the diameter of the bowling ball against said belt after it passes a first of said pulleys to thereby compress said belt, maintain said belt under compression as the ball moves along said generally flat horizontal section and to lower the ball to reduce the compression of said belt before the ball passes under the second of said pulleys out of said exit area and onto a horizontal runway which lies in the same plane as said track in said exit area of said horizontal ball-return.

* * * * *

UNITED STATES PATENT AND TRADEMARK OFFICE

CERTIFICATE OF CORRECTION

PATENT NO. : 5,649,868

DATED : July 22, 1997

INVENTOR(S) : Lawrence Gooss & William M. Riley

It is certified that error appears in the above-indentified patent and that said Letters Patent is hereby corrected as shown below:

On cover page item [73]

change the Assignee line from "AMF Bpwling, Inc.," to

-- AMF Bowling, Inc.,--.

Signed and Sealed this

Nineteenth Day of May, 1998

*Attest:*

*Attesting Officer*

BRUCE LEHMAN

*Commissioner of Patents and Trademarks*